United States Patent [19]

Sasaki et al.

[11] Patent Number: 4,997,289

[45] Date of Patent: Mar. 5, 1991

[54] OVERTAPE-SEALED BAG

[75] Inventors: Koji Sasaki; Kaoru Teshima, both of Yahatanishi, Japan

[73] Assignee: Ohishi Sangyo Co., Ltd., Kitakyushu, Japan

[21] Appl. No.: 466,982

[22] Filed: Jan. 18, 1990

[30] Foreign Application Priority Data

| | | | |
|---|---|---|---|
| Jan. 24, 1989 | [JP] | Japan | 1-14889 |
| Feb. 6, 1989 | [JP] | Japan | 1-26950 |
| Mar. 29, 1989 | [JP] | Japan | 1-77356 |
| Apr. 5, 1989 | [JP] | Japan | 1-86081 |
| Sep. 27, 1989 | [JP] | Japan | 1-251388 |
| Oct. 4, 1989 | [JP] | Japan | 1-117392[U] |

[51] Int. Cl.[5] ..... B65D 33/22

[52] U.S. Cl. ..... 383/78; 383/116; 383/120; 383/55; 383/908; 206/613; 206/632

[58] Field of Search ..... 383/44, 55, 78, 116, 383/120, 908; 206/484.2, 613, 632, 633

[56] References Cited

U.S. PATENT DOCUMENTS

| | | | |
|---|---|---|---|
| 1,791,178 | 2/1931 | Walker | 383/55 X |
| 2,075,166 | 3/1937 | Brady | 383/116 |
| 2,294,846 | 9/1942 | Haungs | 383/55 |
| 2,409,621 | 8/1946 | Geimer et al. | 383/78 X |
| 3,141,601 | 7/1964 | Ayres et al. | 383/78 |
| 3,162,285 | 6/1939 | Scott | 383/78 |

FOREIGN PATENT DOCUMENTS

| | | | |
|---|---|---|---|
| 1244742 | 9/1960 | France | 383/55 |

*Primary Examiner*—George E. Lowrance
*Assistant Examiner*—Jes F. Pascua
*Attorney, Agent, or Firm*—Griffin Branigan & Butler

[57] ABSTRACT

Here is disclosed an overtape-sealed comprising a paper tube, having longitudinally opposite open ends one and/or both of which is covered and sealed with a twofold overtape wherein the overtape is bonded to the paper tube with adhesive having penetrated the outermost layer of the paper tube so that a release resistance established between the overtape and the outermost layer of the paper tube is higher than a release resistance of an inner layer not penetrated by said adhesive with respect to said outermost layer and thereby unsealing of the paper bag can occur along a boundary between the outermost layer and the inner layer or along the inner layer itself of the paper bag in proximity of said boundary.

Here is also disclosed an overtape-sealed bag wherein the paper tube is a gusset paper tube and wherein a pair of mutually opposed outer surface sections of each gusset are bonded to each other with use of adhesive over an area thereof to be covered by the overtape while the corresponding inner surface sections of each gusset are not bonded to the inner surfaces of the paper tube's respective major walls so as to provide shock absorbing means.

9 Claims, 13 Drawing Sheets

OVERTAPE-SEALED BAG

BACKGROUND OF THE INVENTION

The present invention relates to an overtape-sealed paper bag used as a heavy-duty paper shipping bag.

The machine-sewed heavy-duty paper shipping bag (referred to hereinafter simply as "sewn bottom bag") of prior art comprises a paper tube having opposite open ends covered with respective twofold tapes and sealed by machine-sewing said tapes integrally with the paper tube itself. In view of its high economical efficiency, it has conventionally been considered as unavoidably allowable drawback that such machine-sewed bag is more or less moisture absorbable and prone to rupture. However, a recent tendency to require strict quality guarantee of the content has made such moisture absorbability and bag rupture a problem to be solved and accordingly this problem has presently been solved by overtaping the open ends of the paper tube so as to cover stitching-thread as well as sewing perforations.

For the machine-sewed bag of well known art, the side down posture drop test from a height of 1.2 m indicated that the bag ruptures along the sewed lines, i.e., opposite sides on an average after twice of such drop test.

The machine-sewed bag of prior art which has been overtaped as mentioned above certainly reduces the moisture absorbability and possibility of bag rupture but a readiness for unsealing, one of the most important conveniences to be provided by the machine-sewed bag is thereby vitiated and use of the overtape necessarily increases the cost of the bag. In the case of a moisture-proof stitched bag which contains therein a separate bag made of synthetic resin film, the bottom of the inner tube must be heat sealed above the level at which the outer tube will be machine-sewed, since the inner and outer tubes are simultaneously manufactured. This results in a corresponding tube loss (at least 60 mm collectively at top and bottom open ends). Even so far as only the outer tube is concerned, machine-sewing treatment requires margins of approximately 15 mm at top and bottom open ends, respectively. Accordingly, a length of the paper tube for the outer bag must be substantially increased relative to a filling capacity and no material reduction can be achieved.

Furthermore, a paper bag having its bottom open end covered and sealed with a twofold bottom sealing paper is disclosed by Japanese Utility Model Publication No. 1975-3608 whose main object is to provide improved sealing at its bottom open end, not to provide readiness for unsealing.

A paper bag having its bottom open end covered and sealed with a twofold bottom sealing paper sheet which contains, in turn, a tear strip extending horizontally is also known from, for example, Japanese Utility Model Publication No. 1969-7819; Japanese Utility Model Disclosure Gazette No. 1979-106911; and Japanese Utility Model Disclosure Gazette No. 1989-20451. However, a readiness for unsealing depends on a cutting resistance and cutting of the bottom sealing paper sheet and so unsealing of the bag by pulling the tear strip contained therein can not be smoothly done.

As the well known construction closely related to the heavy-duty paper shipping bag of the invention, a bag made of synthetic resin woven fabric having its bottom open end covered and sealed with a twofold synthetic resin tape by use of hot melt adhesive which has a melting point lower than that of said synthetic resin is disclosed by Japanese Utility Model Publication No. 1969-15573. However, such bag of prior art has been found to be extremely poor in its readiness for unsealing.

A similar bag which is made of synthetic resin and has its bottom open end sealed with a twofold synthetic resin tape is disclosed by Japanese Utility Model Publication No. 1966-18387 and Japanese Utility Model Disclosure Gazette No. 1972-8523. However, both of these well known bags have been also found to be very poor in their readiness for unsealing.

SUMMARY OF THE INVENTION

It is an object of the invention to provide an overtape-sealed paper bag presenting an improved strength along its opposite lateral sides as measured by the side down posture drop test, said paper bag being advantageous over the prior art in that the paper bag can be manufactured without requiring any sewing equipment as well as wasteful material for a moisture-proof bag contained therein and the end of the bag is sealed with a high safety for transport and storage but ready for unsealing.

This object is achieved, according to the invention, by an overtape-sealed bag comprising a paper tube having longitudinally opposite open ends one and/or both of which is covered and sealed with a twofold overtape wherein the overtape is bonded to the paper tube with adhesive having penetrated the outermost or surface layer of the paper tube so that a release resistance established between the overtape and surface layer of the paper tube is higher than a release resistance of an inner layer not penetrated by said adhesive with respect to said surface layer and thereby unsealing of the paper bag can occur along a boundary between the surface layer and the inner layer or along the inner layer itself of the paper bag in proximity of said boundary.

The paper bag of the invention has a higher degree of fiber orientation in a longitudinal direction than in a transverse direction of the paper tube.

The overtape is made of a composite sheet laminated or coated with hot melt adhesive, and this sheet may be a sheet of kraft paper or warp/weft plain woven fabric of synthetic resin (e.g., polyethylene or polypropylene) yarn, or a composite sheet of kraft paper and nylon, polyester, polyethylene, or a composite sheet of kraft paper and warp/weft plain woven fabric of synthetic resin (e.g., polyethylene or polypropylene).

The adhesive may be so-called hot melt adhesive containing synthetic resin such as polyethylene (PE) or ethylene/vinyl acetate copolymer (EVA) as a principal ingredient and, to enhance a coherence of the composite sheet, anchoring agent such as polyethylenimine, alkyl titanate or urethane may be additionally used. It should be noted that requirements as set forth below must be considered in selecting a melting point of hot melt adhesive to be used.

A. Hot melt adhesive to be used should have a melting or softening point higher than a temperature of the bag content at which said content is charged into the bag. If the content is at an ordinary temperature, for example, the hot melt adhesive having a melting point of 60° C. to 80° C. may be effectively used. If the content is at a higher temperature of 60° C. to 80° C., the hot melt adhesive to be used must have a melting point of 110° C. or higher.

B. With the paper bag containing therein an inner synthetic resin bag, the hot melt adhesive to be used should have a softening point (or a melting point) lower than that of said synthetic resin. If the synthetic resin has a softening point of 100° C. to 120° C., for example, the hot melt adhesive to be used should have a melting point of 60° C. to 80° C.

Use of the hot melt adhesive is based on a fact that such adhesive is easily controllable to penetrate only the surface layer rather than the inner layer of paper.

In the embodiment in which the outer surface of the paper tube is laminated with synthetic resin film, this synthetic resin film functions as the surface layer of the paper tube. In this case, it is possible to establish a release resistance between the overtake and said synthetic resin film serving as the surface layer of the paper tube higher than a release resistance between said surface layer and the inner layer of the paper tube which has not been penetrated by the adhesive.

The arrangement as has been mentioned above achieves a desirable effect as follows. The open ends of the paper tube can be sealed simply by covering them with the twofold overtapes using suitable adhesive without machine-sewing in the optimal manner for mass production of the paper bag; while the bonded surfaces are subject to a tensile force when a drop shock is exerted on the bag proximate the overtapes, such drop shock is well resisted by a sufficient strength of the paper bag provided by a higher degree of fiber orientation along a flow direction of the paper making machine in cooperation with a strength of the overtapes themselves; and, as an unsealing force is exerted on the overtape covering the top open end of the paper tube, the paper layer extending along said bonded surfaces is subject to a peeling force as if exerted by a lever transversely of said flow direction of the paper making machine, so the unsealing is smoothly achieved, because an interfiber release resistance established transversely of the paper tube is lower than that in said flow direction, i.e., longitudinal direction of the paper tube and a release resistance along the boundary between the layer penetrated by the hot melt adhesive and the layer not penetrated thereby is relatively low. In this manner, the invention provides the paper bag being advantageous over the paper bag of prior art in that the sealed portion has a significantly improved rupture resistance, the operation of unsealing is facilitated without rupturing of the open end, a high safety is assured for transport and storage and the material consumption is reduced particularly for the moistureproof bag.

The above-mentioned object of the invention is also achieved by said overtape sealed bag wherein the paper tube is a pleated paper tube and wherein a pair of mutually opposed outer surface sections of each side pleat are bonded to each other with use of adhesive over an area thereof to be covered by the overtape while the corresponding inner surface sections of each side pleat are not bonded to the inner surfaces of the paper tube's respective major walls so as to provide shock absorbing means.

Said object can be achieved also by said overtape-sealed bag wherein there is provided adjacent one end of one open end to be covered by the overtape a projection which is, in turn, folded inward along oblique lines to provide a filling-sleeve and wherein a pair of mutually opposed outer surface sections of said projection are bonded to each other with use of adhesive over an area thereof while the inner surfaces of said projection are not bonded to the inner surfaces of the paper tube's respective major walls so as to provide shock absorbing means.

With such arrangement, the shock absorbing means is formed along the bottom edges of the outer walls being covered by the overtape so that a shock exerted on the overtape can be laterally dissipated and thereby a bag rupture resistance of the sealed portion is further improved.

The object of the invention as set forth above is also achieved by laminating or coating the inner surface of the overtape with hot melt adhesive so as to form a composite sheet.

This arrangement is advantageous in that the surface layer of paper can be bonded with use of adhesive to the overtape so that a release resistance established between the tape and the surface layer is higher than a release resistance established between said surface layer and the inner layer of paper, allowing the overtape to be easily peeled off together with said surface layer of paper from the paper tube without rupturing of the open end.

Furthermore, by implementing the overtape in the form of a composite sheet having a reinforcing layer comprising, for example, Ny, PET of synthetic resin cloth interposed therein, not only pressure resistance and shock resistance can be further enhanced but also hot melt adhesive of a relatively low melting point can be used as adhesive. In an advantageous consequence, even when a synthetic resin tube is used as the most inner ply, heat-bonding the overtape to the paper tube will not adversely influence on said synthetic resin tube, i.e., the moistureproof bag having a higher melting point, and the shock absorbing means can be easily formed along the bottom edges of the respective gussets upon sealing of the overtape by bonding the pair of mutually opposed outer surface sections of each gusset to each other with use of the same adhesive as the adhesive on the overtape.

For the heavy-duty paper shipping bag of such type as provided by the invention, it is desired that the empty bag left after unsealing thereof can be reused. With the bag constructed according to the invention, as a result of unsealing, only the surface layer of the paper tube over the area having been covered by the overtape is peeled off together with the overtape from the paper bag. Accordingly, said area may be covered again by a fresh overtape and then heat sealed to reuse the bag without a loss of the bag length (the machine-sewed bag has had to be cut off along the stitching line and a bag length loss has been inevitable). This contributes to saving of resources throughout the distribution network.

Now the development details and the features of the invention will be described. Initially, the inventors aimed at opening up new avenues of use for a composite sheet (composition: kraft/PE/AC/Ny or PET/AC/-PE/hot melt) which had been developed by the inventors for a different use and experimentally a flat bag formed from a single ply of paper cloth (PC) was sealed at a bottom with an overtape comprising said composite sheet using a heat sealer. The bag was filled with PE resin and subjected to the side down posture drop test. After seven times of such drop test, no bag rupture occurred. The overtape used for this test had composition of kraft/PE 15μ/PE 15μ/AC/Ny 15μ/AC/PE 15μ/HM 40μ where HM represents hot melt containing PE as a principal ingredient.

In the case of said experimental paper bag, it was found that the overtape is easily peeled off together with the surface layer of paper, leaving a neat peeling trace as one tab-like portions of the overtape (projecting from opposite width ends of the bag) is vigorously pulled.

As previously mentioned, the heavy-duty paper shipping bag merely treated by machine-sewing ruptures after twice of the drop test.

Based on such knowledge, the inventors conducted similar test using the commercially available overtape for use with cloth bag (commonly known as ketchtape having a composition of PE cloth/PE/hot melt) and a substantially same result was obtained. Then a flat bag comprising three plies kraft was subjected to the flat posture drop test, instead of the side down posture drop test and it was found that no bag rupture occurs even after ten times of such drop test.

As for unsealing, the overtape was easily peeled off from the bag by pulling the tab-like portion thereof just as with the first-mentioned experimental bag. In this regard, a flat bag of three plies kraft but treated merely by machine-sewing ruptured after five times of such drop test.

Similar experiment was conducted for a gusset bag (pleated bag) of a single-ply paper cloth, which was constructed in the same manner as mentioned above. It is important for the gusset bag how upper and lower ends of the gusset should be sealed. Examination of various aspects suggested that a pair of mutually opposed outer surface sections of each gusset(V-shaped in section) should be bonded at upper and lower ends to each other over a full width by use of adhesive. While the adhesive is preferably of hot melt type, adhesive of emulsion type may be also used.

The gusset bag thus experimentally made was sealed with said commercially available overtape for use with cloth bag and subjected to both the horizontal posture drop test and the side down posture drop test. No bag rupture occurred even after ten times of both drop tests, respectively. The overtape was easily peeled off from the bag by pulling the ear-like portion thereof, as with the previously mentioned bags.

In the similar manner, the gusset bag treated by machine-sewing was subjected to the drop test and it was found that no rupture occurs after the horizontal posture drop tests but the bag ruptures even after the first side down posture drop test.

The inventors discovered from series of tests as have been mentioned above that, with the arrangement according to the invention, the overtape is peeled off from the bag together with paper fibers removed from the bag and clinging to substantially the whole surface of hot melt with a uniform thickness.

More specifically, the inventors discovered that the overtape is peeled off together with the surface layer of paper from the inner layer thereof due to a difference between a release resistance of the surface layer penetrated by the hot melt and a release resistance of the inner layer not penetrated thereby. Furthermore, the inventors sought the other factors which might support the above-mentioned phenomenon of paper layer peeling off by tracing back the manufacturing process and arrived at the following conclusion.

Namely, paper is classified into multi-layered paper in which the paper fibers are stratified and single-layered paper in which the paper fibers are horizontally entangled with one another. In both types, the paper fibers have a higher degree of orientation in a flow direction of the paper making machine than in a direction transverse thereto. At the same time, it was found in connection with such orientation characteristic of paper fibers that a tensile resistance of paper itself is higher in the flow direction of the paper making machine than in the direction transverse thereto and a release resistance in the transverse direction is lower than a release resistance in said flow direction. It was also found that a netty porous structure is formed by the stratified or entangled fibers.

It was also discovered that the hot melt of the overtpape activated and molten by heating penetrates the pores formed among the layered paper fibers and is cold solidified with a uniform depth because the overtape is uniformly laminated or coated with said hot melt.

It was also discovered that a strength of the overtape can be further improved by implementing the overtape in the form of a composite sheet containing Ny, PET or warp/weft fabric of synthetic resin yarn interposed therein.

Thus a theoretical basis was obtained to back up a fact that the present invention enables the overtape to resist a drop shock and facilitates unsealing of the paper bag.

Specifically, while the bonded surfaces are subject to a tensile force when a drop shock is exerted on the bag proximate the overtape, such drop shock is well resisted by a sufficient strength of the paper bag provided by a higher degree of fiber orientation along a flow direction of the paper making machine cooperating with a strength of the overtape itself and, as an unsealing force is exerted on the overtape, the paper layer extending along said bonded surfaces is subject to a peeling force as if exerted by a lever transversely of said flow direction of the paper making machine, so the unsealing is smoothly achieved because an interfiber release resistance established transversely of the paper bag is lower than that in said flow direction, i.e., longitudinally of the paper bag and a release resistance along the boundary between the layer penetrated by the hot melt adhesive and the layer not penetrated thereby is relatively low.

In this manner a bag rupture resistance of the sealed portion is significantly improved, the bag can be easily unsealed without rupture of the opened end, a high safety is assured for transport and storage, and material consumption can be reduced particularly for the moistureproof bag.

As will be apparent from the foregoing description, the present invention is characterized by that the overtape is bonded to the paper tube with use of adhesive having penetrated the outermost layer of the paper tube so that a release resistance established between the overtape and the outermost layer of the paper tube is higher than a release resistance of an inner layer not penetrated by said adhesive with respect to said outermost layer and thereby unsealing of the paper bag can occur along a boundary between the outermost layer and the inner layer or along the inner layer itself of the paper bag in proximity of said boundary.

BRIEF DESCRIPTION OF THE DRAWINGS

The above and there objects of the invention will be seen by reference to the description taken in connection with the accompanying drawings, in which.

Figure 19:
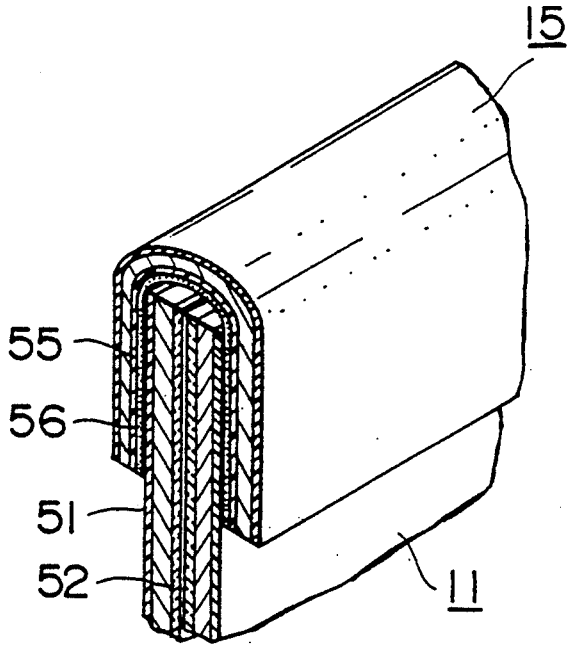
FIG. 19. shows, in a perspective view partially broken away longitudinally, the overtape-sealed portion in a fourth embodiment of the invention as has been sealed.
Figure 20:
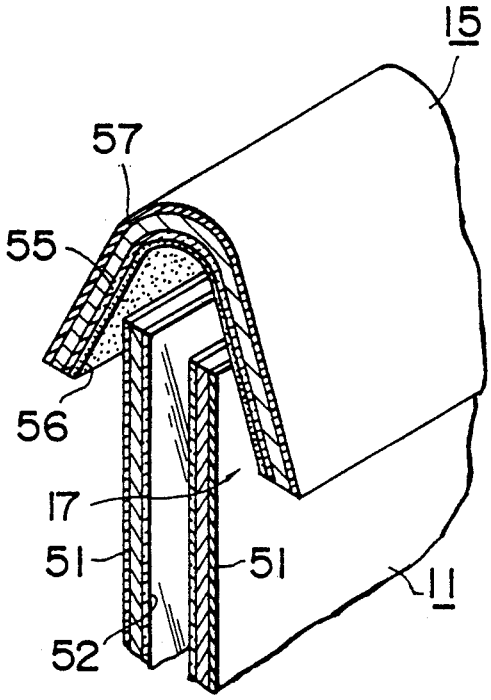
FIG. 20 shows, in a perspective view partially broken away longitudinally, the overtape of FIG. 19 as being prior to sealing the paper tube.
Figure 21:
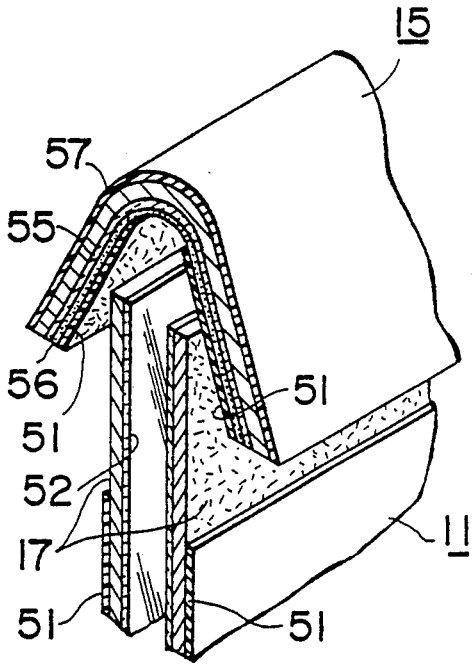
Figure 22:
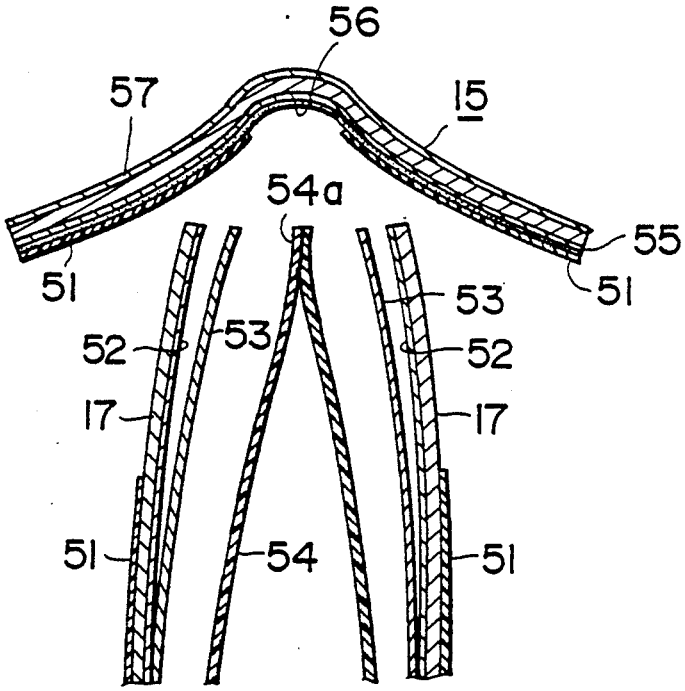
Figure 25:
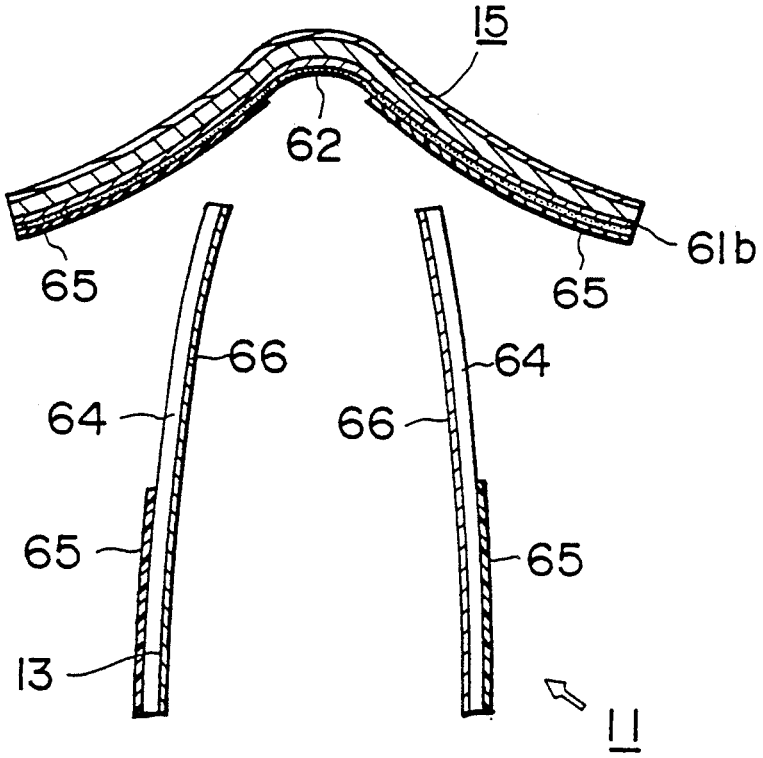
Figure 26:
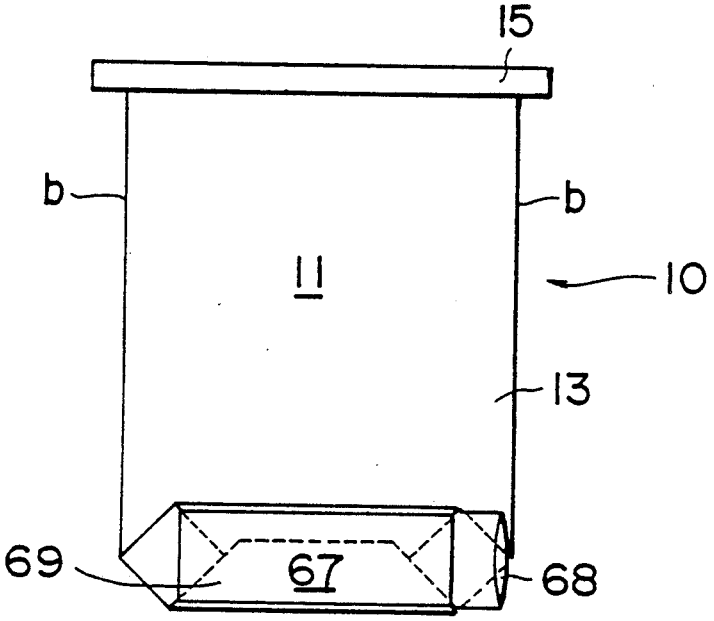
Figure 23A:
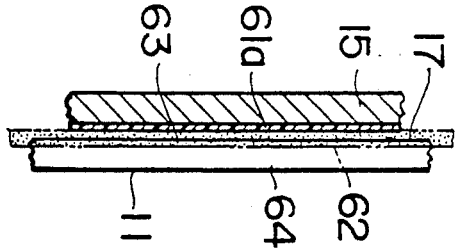
Figure 23B:
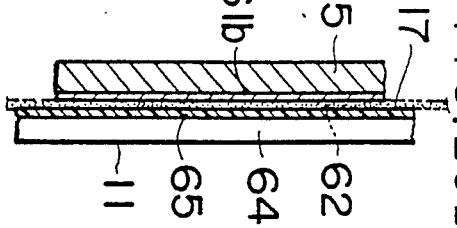
Figure 23C:
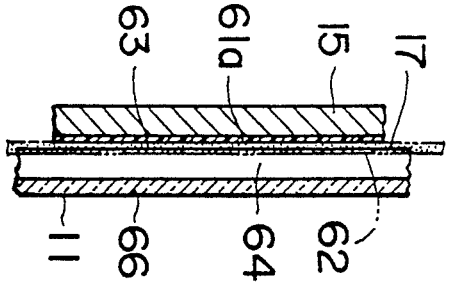
Figure 23D:
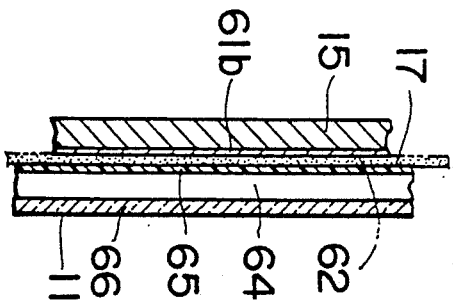
Figure 27:
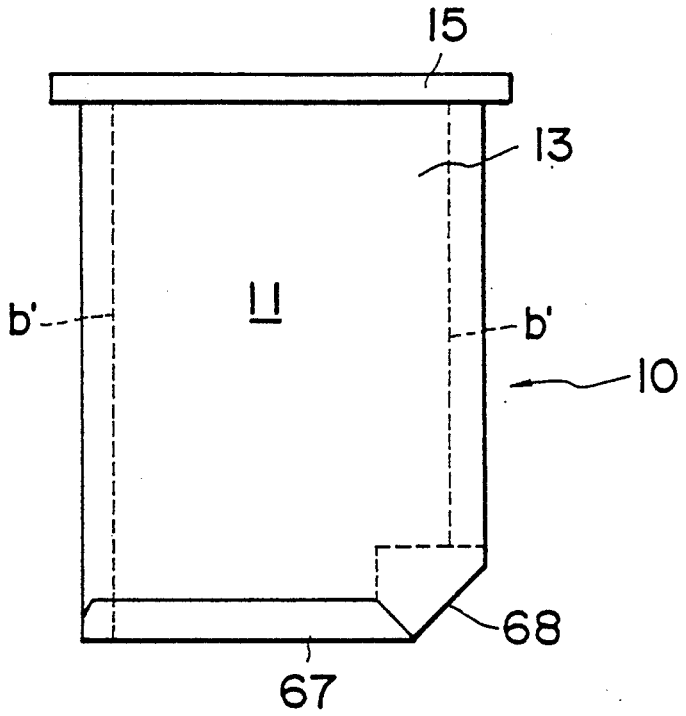
Figure 28:
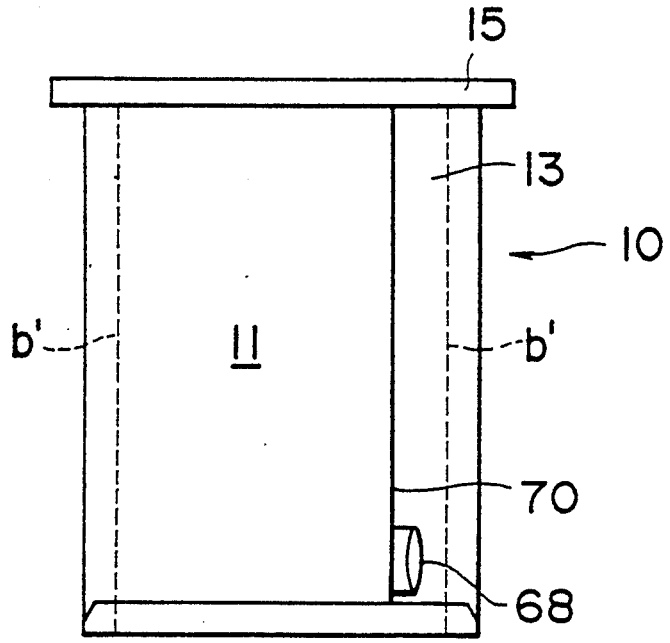

FIG, 21 shows, in a perspective view partially broken away longitudinally, the overtape of FIG. 19 as after having unsealed the paper tube;

FIG. 22 shows, in a longitudinal section, the paper tube as shown in FIG. 19 but implemented in the form of a three-plies bag after the overtape has been peeled off;

FIG. 23A shows, in a longitudinal section, a state in which the overtape has been bonded to the paper tube in a fifth embodiment of the invention;

FIG. 23B shows, in a longitudinal section, a state in which the overtape has been bonded to the paper tube 11 having an outer surface laminated with synthetic resin layer 65 in the place of the surface layer 63 in FIG. 23A;

FIG. 23C shows, in a longitudinal section, a state in which the overtape has been bonded to the paper tube having an inner fibrous layer 64 shown by FIG. 23A lined with a synthetic resin cloth sheet 66;

FIG. 23D shows, in a longitudinal section, a state in which the overtape has been bonded to the paper tube so that said manners of bonding shown by FIG. 23B and 23C are combined;

FIGS. 24A through 24D show, in longitudinal sections, states in which the respective overtapes have been peeled off from the respective positions shown by FIGS. 23A through 23D;

FIG. 25 shows, in an enlarged longitudinal section, a state in which the overtape of FIG. 23D has been peeled off from the open end and the outer peripheral surface around said open end;

FIG. 26 shows, in a front view, a valved pasted flat hexagonal bottom bag bottom; and FIG. 27 and 28 show, in front views, pinch bottom bags provided with a folded filling-sleeve and an inserted filling-sleeve, respectively.

DETAILED DESCRIPTION OF THE INVENTION

A first embodiment of the invention using flat bag (flat paper bag) will be described in reference with FIGS. 1 through 5.

Figure 5:
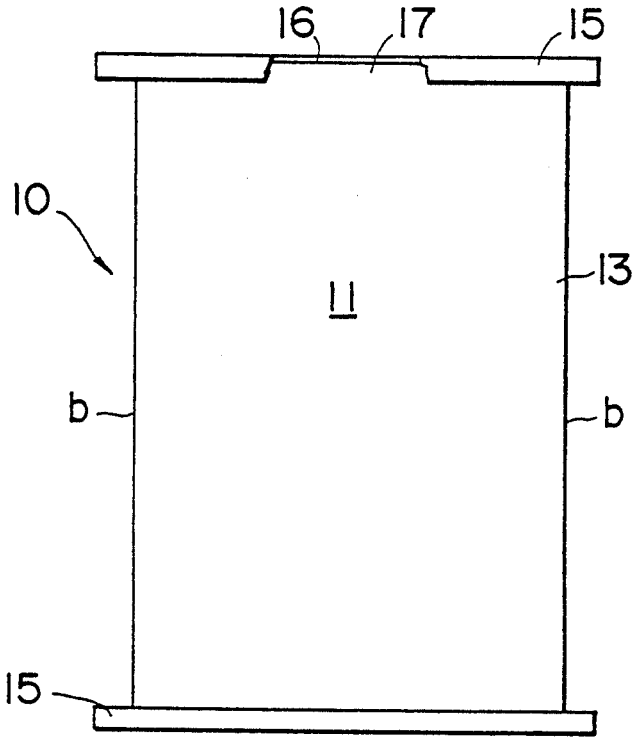
FIG. 5 and 6 show, in front views partially broken away, a flat paper bag and a gusset paper bag, respectively.

Referring to FIG. 5, there is shown a paper bag generally designated by reference numeral 10. Paper web delivered from a roll is longitudinally folded up and bonded together along opposite side lines b, b, perpendicular to lines along which to cut a length of the individual bag off, and the individual bag lengths are cut off to form paper tubes 11. Cut off ends of each paper tube 11 define open ends 16. Opposite outer surfaces 17, 17 of the paper tube 11 in proximity to the respective open ends 16 are covered and sealed with associated over tapes 15 to form a heavy-duty paper shipping bag. The paper web constituted the outermost paper 13 of the paper tube 11 may be pulp fiber accumulated paper such as craft paper or extensive paper. The paper web is higher in its fiber orientation degree in the longitudinal direction than in the transverse direction and cutting off of the individual paper tubes 11 occurs transversely of the paper web so that the individual paper tubes 11 are also higher in their fiber orientation degree in the longitudinal direction than in the transverse direction thereof and, therefore, their longitudinal tensile strength is higher than their transverse tensile strength. Namely, referring to FIG. 5, the tensile strength along the side lines b. b is higher than the tensile strength as measured transversely thereof.

Figure 3:
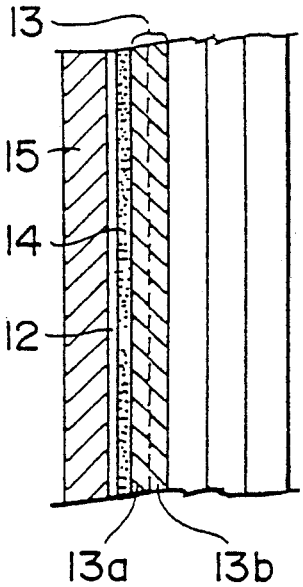
FIG. 3 shows, in a longitudinal section, the overtape bonded to the outermost layer of paper.
Figure 4:
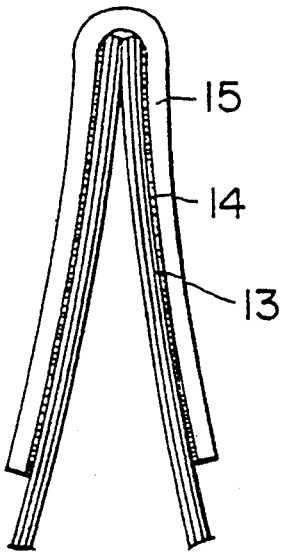
FIG. 4 shows, in a longitudinal section, the overtape-sealed portion in the similar embodiment referring to the first embodiment of FIG. 1.

The overtapes 15 may be of craft paper, plain weave fabric using polyethylene yarn as warp and weft, or the like. Said overtapes 15 have their inner side laminated with hot melt adhesive 14 of polyethylene, these laminated areas are put on the outer surfaces 17, 17 proximate the respective open ends 16 of the paper tube 11 and thereafter these assembly is heated until the adhesive 14 penetrates a surface layer 13*a* of said outermost paper 13. At this time point, the adhesive 14 may be subjected to cold solidification for adhesive integration of said surface layer 13*a* and tape 15 as best seen in FIG. 3. Reference numeral 12 designates a reinforcing layer of synthetic resin such as nylon or polyester and there is a layer of anchoring agent between this reinforcing layer 12 and the tape 15.

The adhesive 14 does not penetrate an inner layer 13*b* of the outermost paper 13 and, with a consequence, a release resistance established between the surface layer 13*a* and the inner layer 13*b* is lower than a release resistance established between the tape 15 and the surface layer 13*a*.

Figure 8:
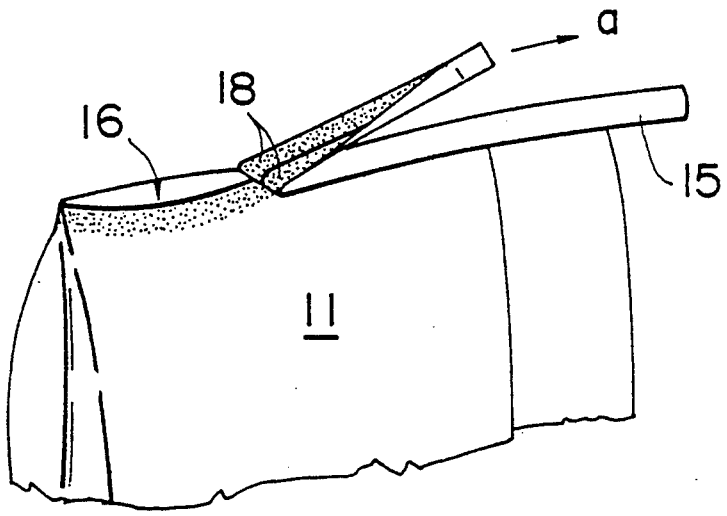
FIG. 8 shows, in a perspective view, a manner in which the overtape-sealed portion is peeled off.
Figure 9A:
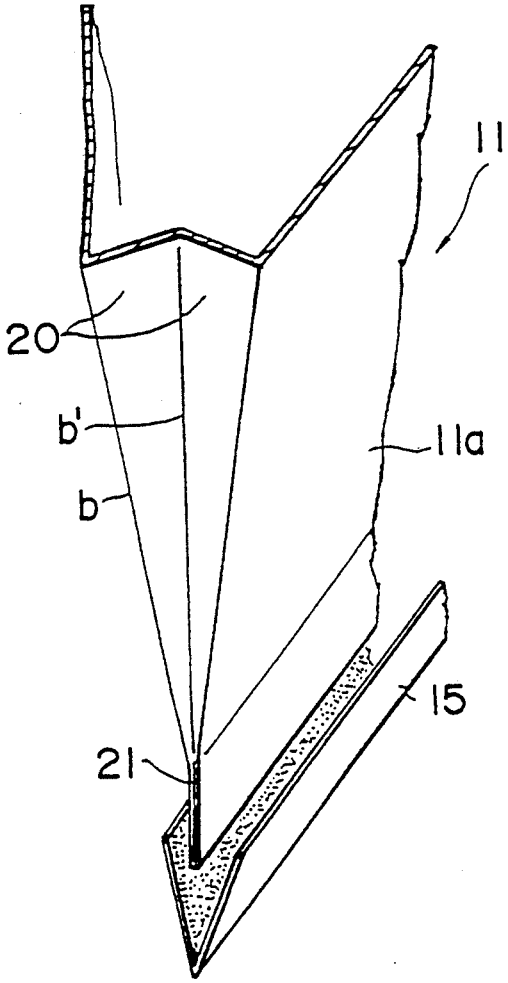
FIG. 9A shows, in an exploded view, shock absorbing means in a second embodiment of the invention.
Figure 10:
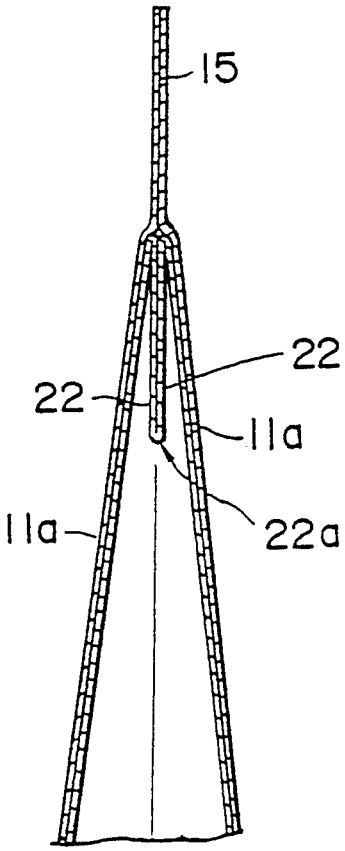
FIG. 10 shows, in a section, said shock absorbing means of FIG. 9A.
Figure 9B:
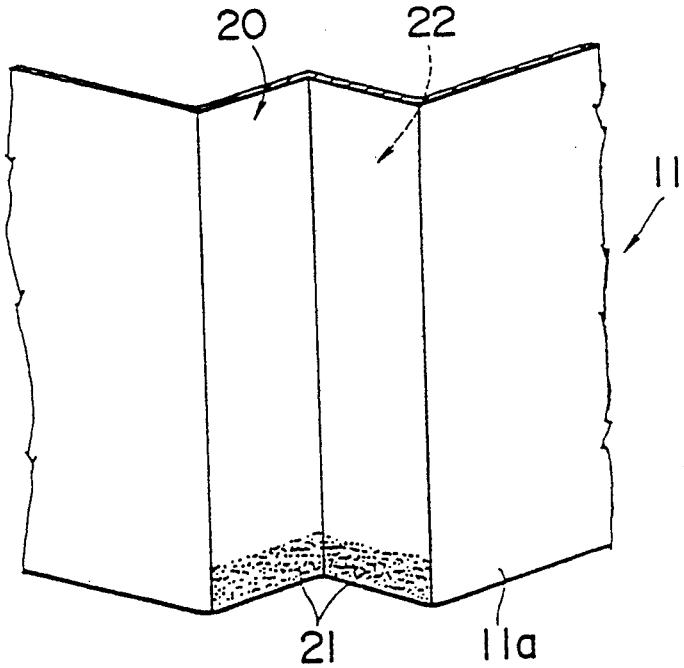
FIG. 9B shows, in an exploded view, one of opposite outer side gussets of FIG. 9A.

Accordingly, when an end of the tape 15 is pulled in a direction "a" indicated by an arrow in FIG. 8, the tape 15 is peeled off together with the surface layer 13*a* from the inner layer 13*b* of the outer most paper and thereby the bag is unsealed.

Figure 2:
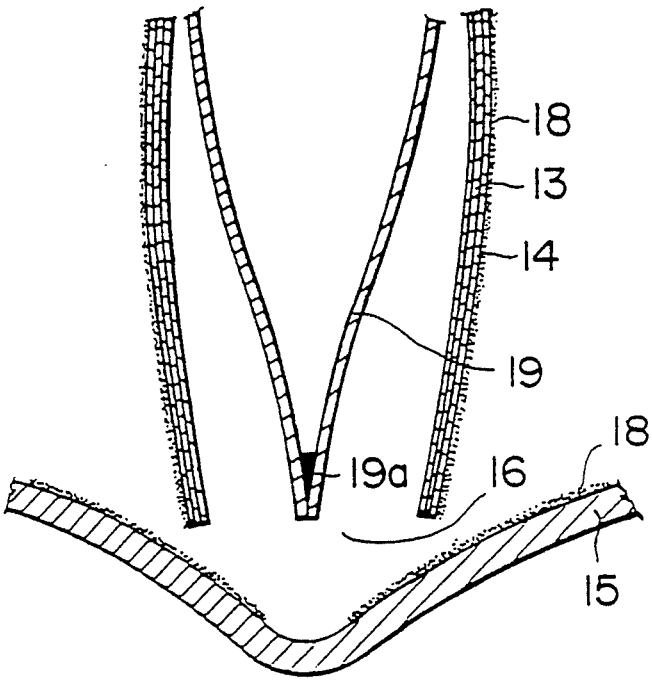
FIG. 2 shows, in a longitudinal section, the overtape-sealed portion as has been unsealed.

FIG. 2 illustrates, in a section, the overtape as having been peeled off from the bag end and reference numeral 18 designates fine fluffs appearing on the area from which said overtape has been peeled off.

Substitute of the overtape comprises a composite sheet of kraft paper and nylon or polyester (using suitable anchoring agent or polyethylene having m.p. of 110° C. or the like for lamination); kraft paper and polyethylene, kraft paper and plain weave fabric of polyethylene or polypropylene yarn. Each component sheet is laminated or coated on its inner surface with hot melt adhesive.

Figure 1:
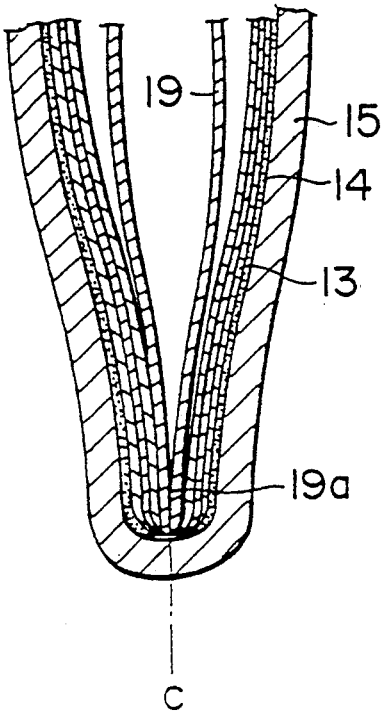
FIG. 1 shows, in a longitudinal section, an overtape-sealed portion in a first embodiment of the invention.
Figure 6:
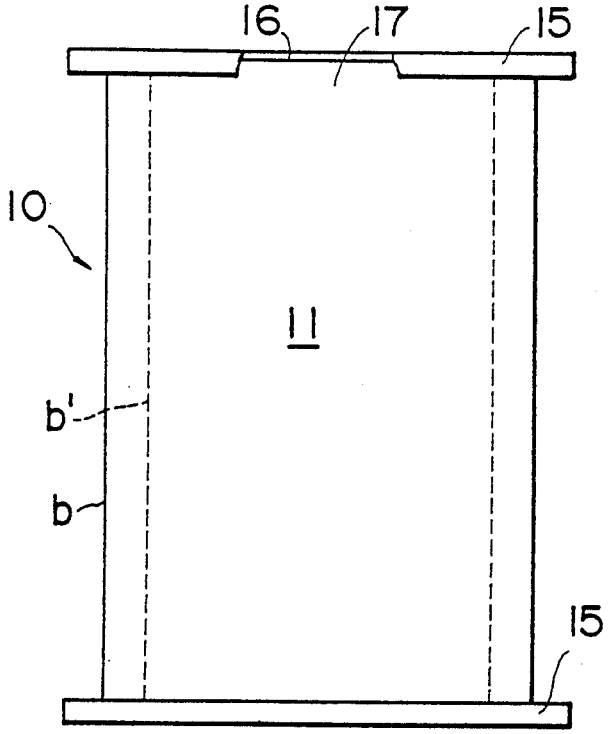
Figure 7:
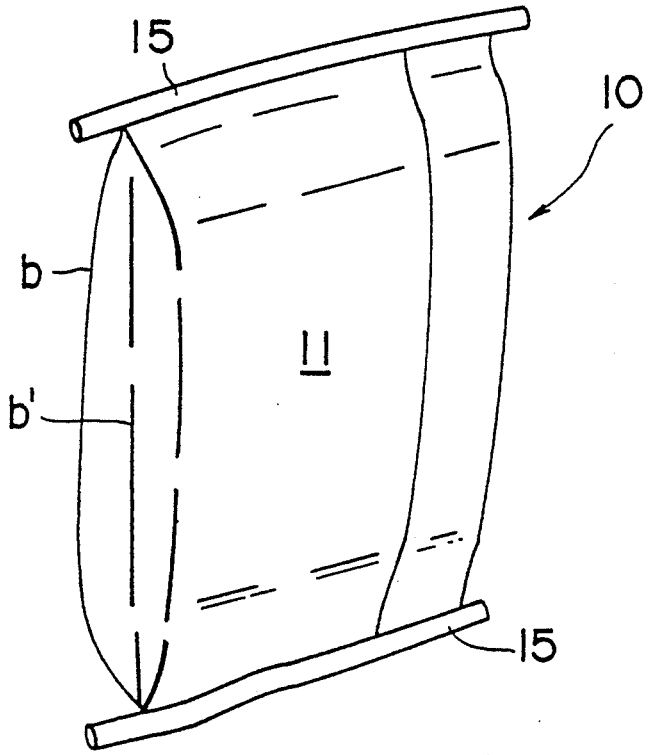
FIG. 7 shows, in a perspective view, the paper bag of FIG. 6 as has been filled with content.

The paper tube 11 may be a flat bag as shown by FIG. 5 or a gusset bag (side gusseted bag) as shown by FIGS. 6 and 7. The gusset bag is provided along each side with a pair of creases b, b and an intermediate fold b'. Such paper tube 11 may be provided thereinside with a polyethylene tube 19 as shown by FIGS. 1 and 2. Reference numeral 19*a* designated heat sealed areas.

It will be apparent that the sealing with the twofold overtape 15 may be adopted for longitudinally opposite ends of the paper tube 11.

FIGS. 9 through 12 illustrate a second embodiment of the invention according to which each laterally outer side wall of the paper tube is provided along upper or lower edge with shock absorbing means. Specifically, a pair of outer side wall sections 20, 20 separated along the intermediate fold b' of the paper tube 11 are uniformly bonded to each other along a bottom edge 21 while inner surface sections 22, 22 respectively opposite to said outer side wall sections 20, 20 along the bottom edge 21 are not bonded to the associated major walls 11*a* of the paper tube 11. By sealing the shock absorbing area arranged in this manner with the overtape 15, the bag rupture can be minimized even a shocking load is exerted to both sides of the tape 15 with respect to the fold C in a direction perpendicular to said fold C since the inner side sections 22, 22 are free from the respective major walls 11*a* of the paper tube 11 and such shocking load is absorbed and dissipated by an inner gusset 22*a* defined by said free inner side sections 22, 22.

Figure 11:
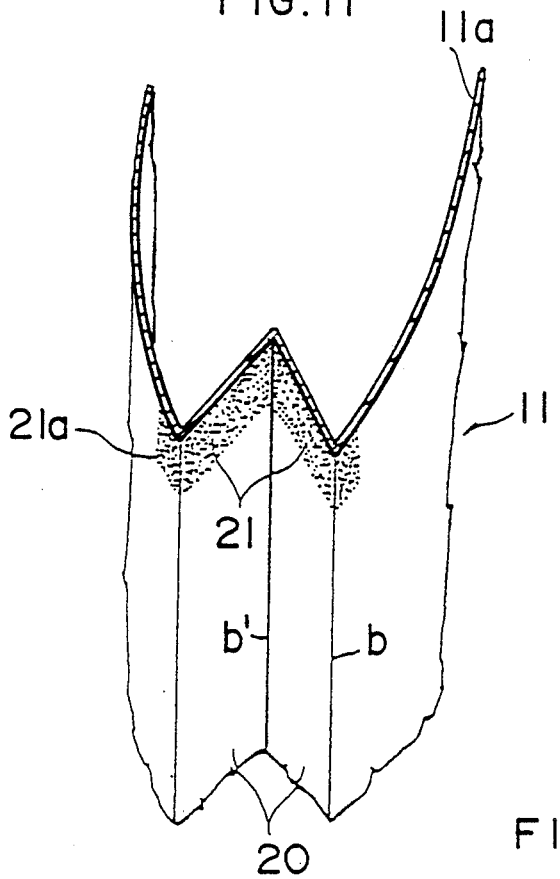
FIG. 11 shows, in a perspective view, a paper tube 11 referring to the second embodiment.
Figure 12:
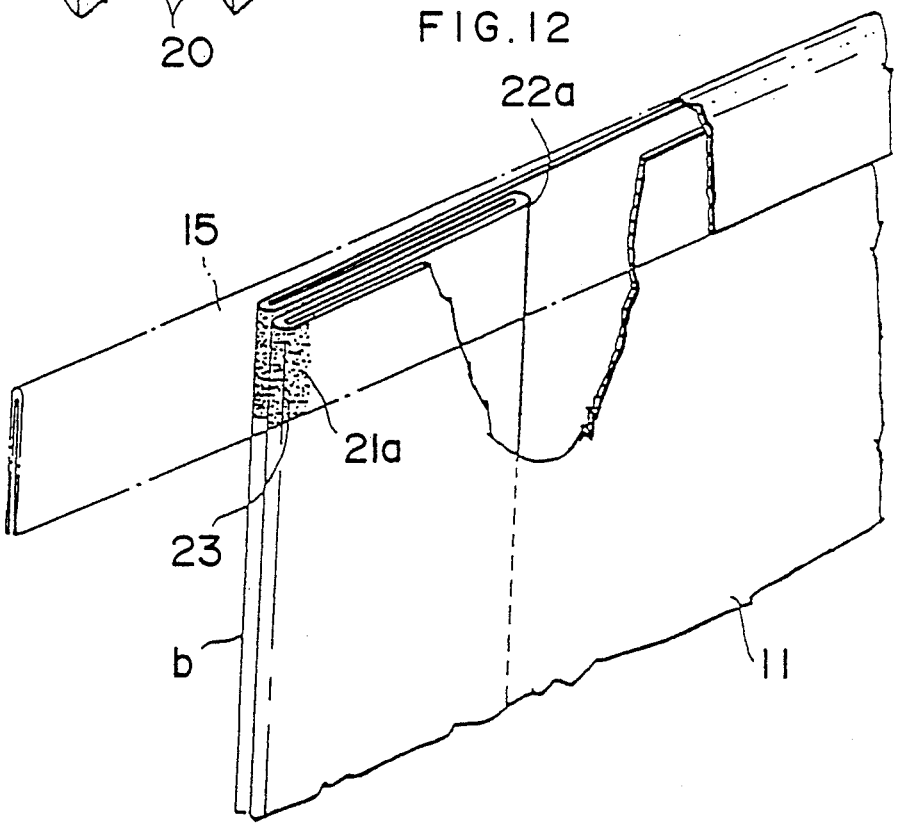
FIG. 12 shows, in a perspective view partially broken away, the overtape-sealed portion using the paper tube of FIG. 11.

It should be noted that, when the opposite outer side wall sections 20, 20 are uniformly bonded to each other along the bottom edge 21, the adhesive may extend, as shown by FIG. 11, slightly beyond the respective gusset lines b, b defining each outer side line of the bag to each outer end area 21*a* of the bag which is opposed to the overtape 15.

Figure 13:
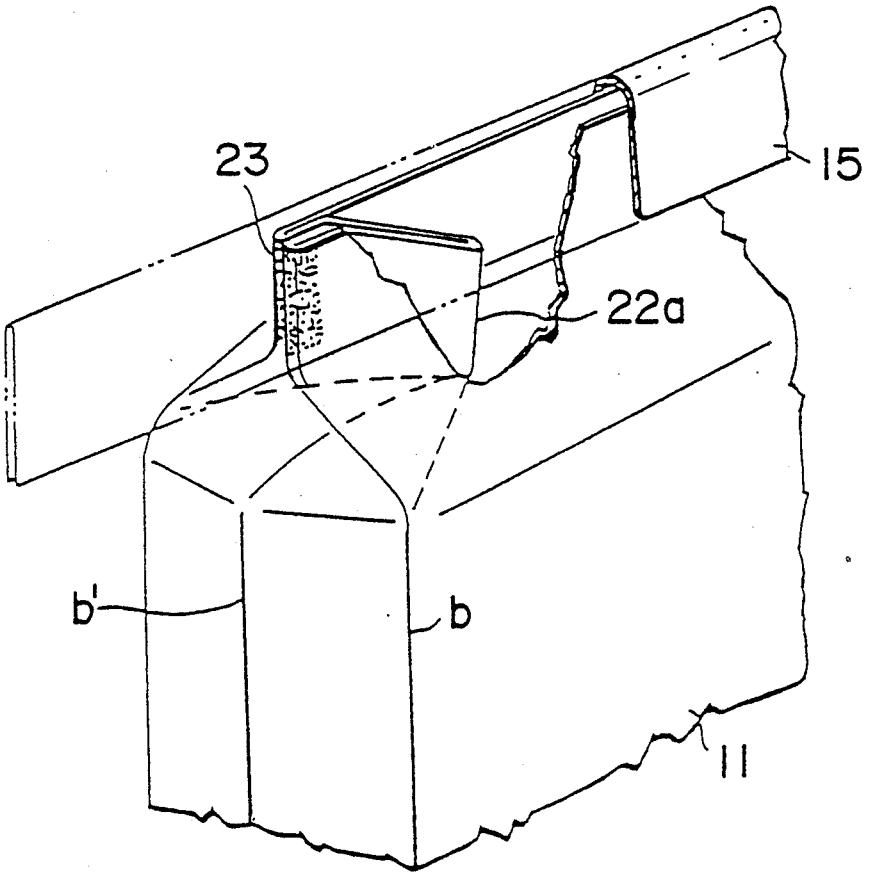
FIG. 13 shows, in a perspective view partially broken away, the overtape-sealed portion of the paper bag shown by FIG. 12 as has been filled with content.

In any case, the shock absorbing means 22*a* serving for the bottom ends 21 of each outer side wall along which each pair of outer side wall sections 20, 20 are bonded to each other is free from the inner surfaces of the respective major walls 11*a* to move along the inner surfaces of the respective major walls 11*a*. External force of various kinds such as a drop shock encountered by the bag in the course of filling the bag with a content or handling thereof after filled with the content is effectively absorbed by the shock absorbing means 22*a* to avoided a rupture of the overtape 15 and the tube 11 itself, because said external force causes each pair of outer side wall sections 20, 20 outwardly as seen from FIG. 13, and the shock absorbing means 22*a* pivotally moved around an area 23 along which the bottom ends 21 of paired outer side wall sections 20, 20 are bonded to each other so as to absorb said external force. Following experimental examples were conducted in accordance with JIS ZO217 "Drop Testing Method for Kraft Paper Sacks".

EXAMPLE A

1. A Paper bag 11 constructed according to the invention was filled with 25 Kg powdery material and subjected to the side down posture drop test from 1.2 m above the floor. No rupture of the bag was found after seven times of such drop test.

In contrast with this result, the machine-sewed bag of prior art ruptured after twice of the same drop test.

2. The paper bag of the invention filled with 25 Kg of powdery material was subjected to the horizontal posture drop test (from a height of 1.2 m above the floor) and no rupture of the bag was found after ten times of the drop test. The machine-sewed bag of prior art ruptured after four or five times of the same drop test.

FIGS. 14 through 18 illustrate a third embodiment of the invention in which the bag is provided by the side of the opening with a filling-sleeve 30.

To form such filling-sleeve 30, mutually opposite open end 31, 31 extending along the open end 16 are formed on their respective one sides with vertical edges 32, 32 which define together with a horizontal edge 33 connecting these vertical edges 32, 32 as an projection 34 of the paper tube 11.

Figure 15:
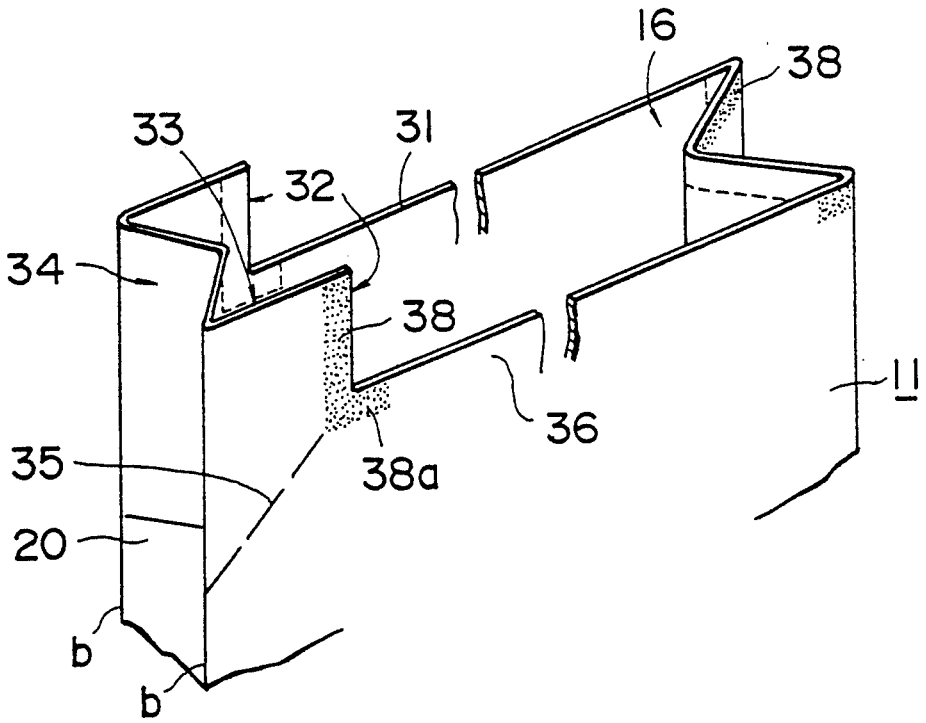
FIG. 15 shows, in a perspective view, the sealed portion shown by FIG. 14 including an open end 31 and a projection 34 as being unfolded.
Figure 16:
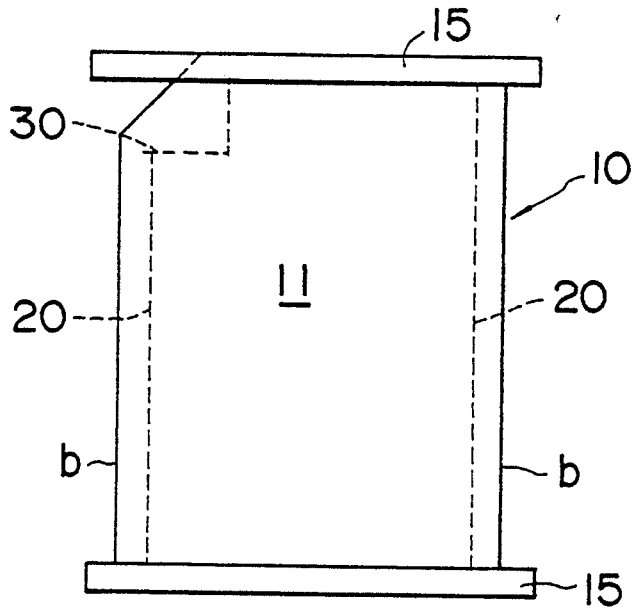
FIG. 16 shows, in a front view, the paper bag of FIG. 14.
Figure 17:
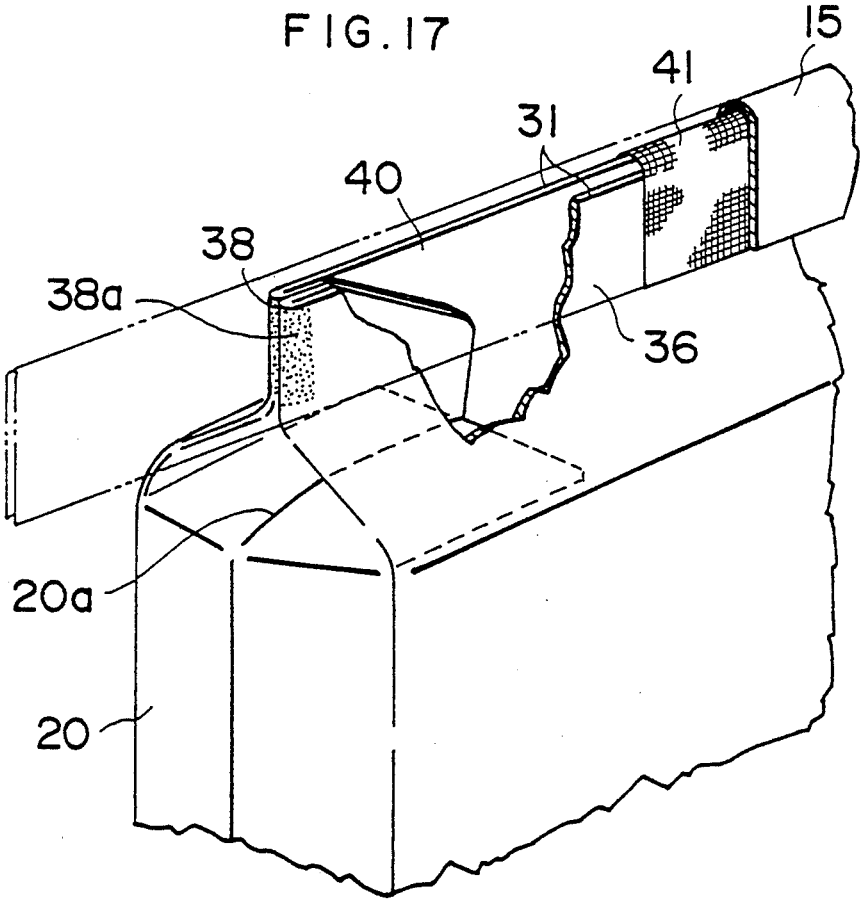
FIG. 17 and 18 show, in perspective views partially broken away, the overtape-sealed portion as of the paper bag of FIG. 14 as has been filled with powdery material.
Figure 18:
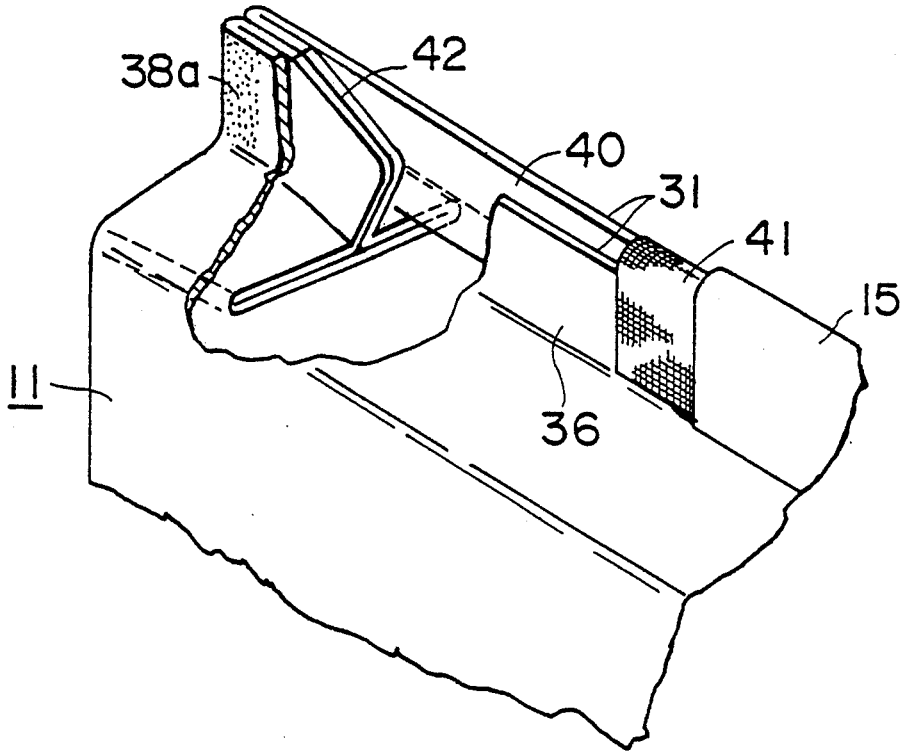

This projection 34 is folded inwards along oblique lines 35, 35 to form the filling-sleeve 30 as shown by FIG. 15. Then, the open ends 31, 31 and the outer surfaces 36, 36 proximate these open ends are covered with the overtape 15 so as to seal said open ends 31, 31.

Figure 14:
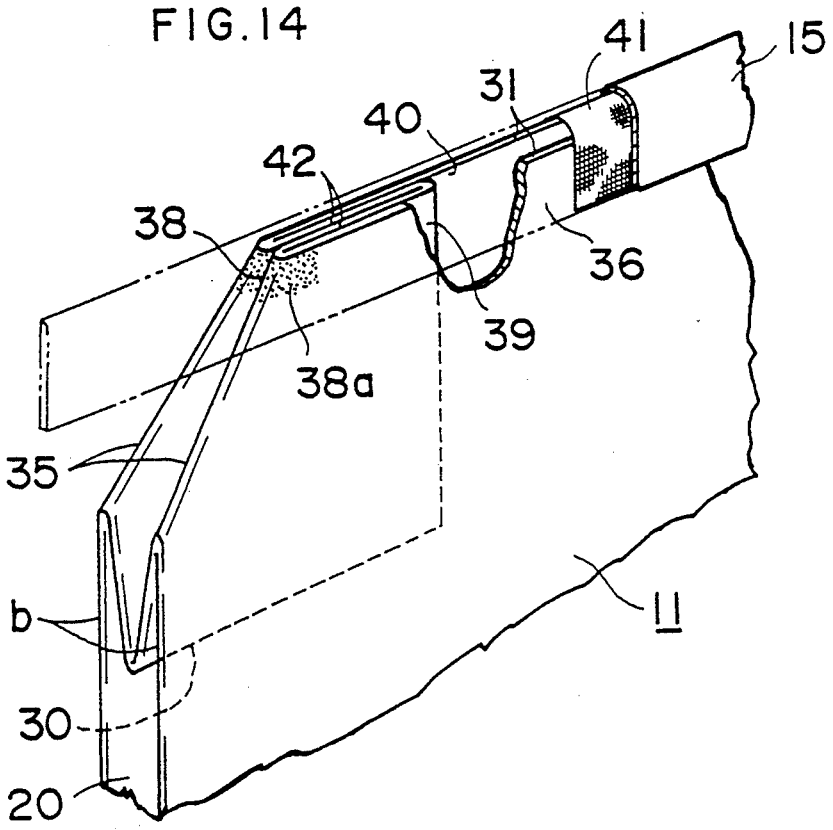
FIG. 14 shows, in a perspective view partially broken away and viewed from outer side, the overtape-sealed portion in a third embodiment of the invention.

In this regard, it will be apparent from FIG. 15 that adhesive areas 38, 38 may be previously placed along the vertical edges 32, 32 to assure that these adhesive areas 38, 38 are opposed and bonded to each other as the projection 34 is folded inwards along the oblique lines 35, 35 as seen in FIG. 14. Inner sides 39, 39 of the projection are not bonded to inner sides 40, 40 of the respective open ends so that upper edge 42 of the inner side 39 defined by a part of the projection which has been folded inwards is pivotally moved along the inner sides 40 of the open ends as the bag is filled with powdery material or the like, as best seen from FIGS. 17 and 18. Such pivotal movement is due to a fact that the outer side wall 20 projects outwards under a filling pressure of said powdery material or the like into the paper bag and thereby adapts itself to said filling pressure. This pivotal movement forces the upper portion 20*a* of the outer side wall 20 substantially up to a horizontal position and the upper portion 20*a* will be supported by the overtape 15. With such arrangement, the inner end of the filling-sleeve 30 exhibits a high sealing effect, alleviating a possibility that leakage of powdery material or the like could occur after filling thereof.

Reference numeral 41 in FIG. 14 designates warp-/weft plain weave fabric of polyethylene or polypropylene yarn and reference numeral 38*a* designates adhesive areas respectively extending from the adhesive areas 38, 38 so as to be placed on the outer surfaces 36, 36 proximate the outer end of the open end 31.

So far as the remaining structural features are concerned, this embodiment is identical to the first embodiment of the invention.

EXAMPLE B

1. The paper bag according to the third embodiment was filled with 25 Kg of powdery material and subjected to side down posture drop test as prescribed by JIS standard in accordance with which the paper tube 11 is held in side down posture and dropped from a height of 1.2 m above the floor. No rupture of the bag was found even after 10 times of the drop test. In contrast with this, the machine-sewed bag of prior art ruptured along the stitching line after only twice of the drop test.

2. The paper bag of this embodiment filled with 25 Kg of powdery material was subjected to the vertical drop test as prescribed by JIS standard in accordance with which the bag is held vertically and dropped from a height of 1.2 m above the floor. No rupture of the bag was found even after ten times of the drop test. The machine-sewed bag of prior art ruptured after four or five times of the drop test.

FIG. 19 through 22 illustrate a fourth embodiment of the invention in which the paper tube 11 is laminated on the outer side with synthetic resin film and the overtape is lined with synthetic resin sheet.

As shown by FIG. 19, the paper tube 11 is laminated on the outer side with synthetic resin film 51 and is lined on the inner side with synthetic resin sheet 52. The mutually opposite outer surfaces 17, 17 proximate the open end of the paper tube 11 is covered and sealed with the overtape 15. The overtape 15 is made of kraft paper and lined with sheet 55 of synthetic resin cloth. The sheet 55 bears thereon hot melt adhesive 56 applied thereon so that the synthetic resin film 51 on the mutually opposite outer edge surfaces 17, 17 are bonded to the synthetic resin sheet 55 linging the overtape 15 with interposition of said hot melt adhesive 56 by externally heating the overtape 15 up to a temperature of approximately 150° C.

One of opposite open ends of the paper tube 11 is previously sealed and the other is sealed after the paper tube 11 has been filled with powdery material or the like.

As will be apparent from FIG. 8, the overtape 15 is released together with the synthetic resin film 51 from the outer surfaces 17, 17 proximate the opening, as seen in FIG. 22, as the overtape 15 is unsealed. This is due to a fact that a release resistance to assured between the paper tube 11 and the synthetic resin film 51 in a direction normal to these layers is sufficiently high to resist the load of filled material but a release resistance in a direction as indicated by the arrow "a" in FIG. 8 is relatively low. The synthetic resin film 51 is readily released from the paper tube 11 and substantially peeling off of paper occurs from the mutually opposite outer surfaces 17, 17 proximate the opening of the paper tube 11.

The synthetic resin film 51 coating or laminating the outer surface of the paper tube 11 reinforces the paper tube 11 and provides a high moistureproofness. The synthetic resin film 51 also enhances the sealing effect of the overtape 15 when the paper tube 11 is sealed with said overtape 15. Both the sheets 52, 55 made of synthetic resin cloth advantageously reinforce the paper tube 11 and the overtape 15.

As will be apparent from FIG. 22, the paper tube 11 may contain therein an intermediate paper tube 53 having a length substantially same as that of the paper tube 11 and this intermediate paper tube 53 may contain therein, in turn, a synthetic resin film tube 54. The synthetic resin film tube 54 may be provided in proximity of an open end thereof with mutually opposed sealing areas 54*a* adapted to be welded together by externally heating the paper tube 11 along said sealing areas approximately to a temperature of 250° C. The outer surface of the overtape 15 is laminated with synthetic resin film 57.

FIGS. 23 through 28 illustrate a fifth embodiment of the invention in which the overtape is lined with synthetic resin sheet and this synthetic resin sheet is bonded with adhesive to the outer wall around the open end of the paper tube 11 so that a release resistance established between said synthetic resin sheet and the outermost layer of said outer wall is higher than a release resistance established between said outermost layer and the inner fibrous layer of said outer wall.

As has been mentioned with respect to the first embodiment, the substrate paper comprises pulp fiber accumulation layer such as kraft paper or extensive paper which has been manufactured so that the individual fibers are oriented longitudinally of the paper tube and, as a result, a tensile strength as measured longitudinally of the paper tube is higher than that as measured transversely of the paper tube.

Figure 24A:
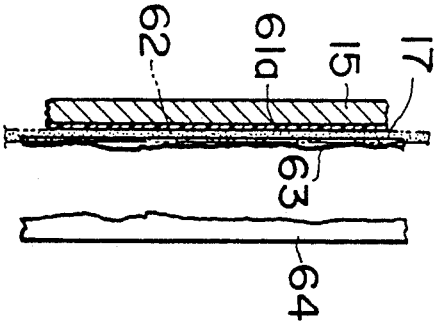
Figure 24B:
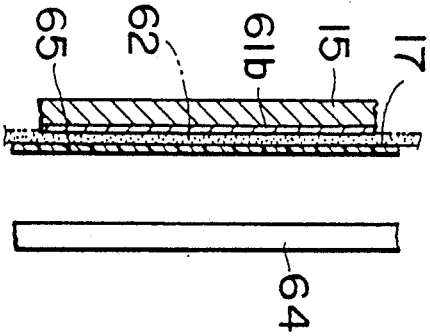
Figure 24C:
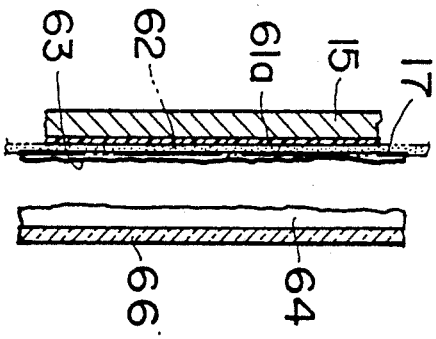
Figure 24D:
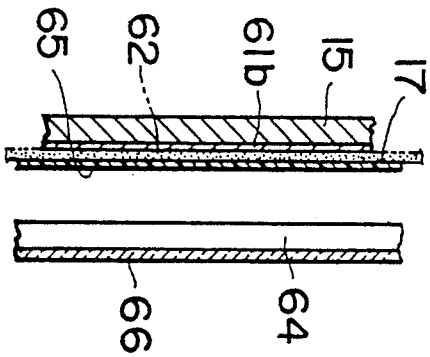

The overtape 15 is made of, for example, a composite sheet of kraft paper lined with synthetic resin sheet 61*a* of polyethylene or the like and warp/weft plain weave fabric sheet 61*b* of polyethylene yarn. Said synthetic resin sheet 61*a* or said warp/weft plain weave fabric sheet 61*b* is laminated with hot melt adhesive layer 62 containing polyethylene having m.p. of 60° C. to 80° C. as a principal ingredient. The overtape 15 is lined also with hot melt adhesive layer 62 and heated with said hot melt adhesive layer 62 being opposed to the open end 31 of the paper tube 11 as well as the outer edge surface 17 of the paper tube 11 therearound until said hot melt adhesive 62 penetrates the outermost layer 63 of the paper tube 11. At this point, the adhesive layer is cooled for solidification and thereby said outermost layer 63 is integrally bonded to the synthetic resin sheet 61*a* or the warp/weft plain weave fabric sheet 61*b* on the overtape 15. The interfiber release resistance which was established during paper making process is maintained because said hot melt adhesive 62 did not penetrated the inner fibrous layer 64 and such interfiber release resistance is lower than the release resistance provided between the outermost layer 63 and the synthetic resin sheet 61*a* or the warp/weft plain weave fabric sheet 61*b*. Accordingly, the outer wall 17 which has been sealed is unsealed along the boundary between the outermost layer 63 and the inner fibrous layer 64 as the overtape 15 is peeled off from the paper tube, as shown by FIGS. 23A and 24A. It should be understood that the outermost layer 63 may include a part of the inner layer.

The paper tube may be a flat bag as illustrated by FIG. 26 or a gusset bag (having gussets on opposite sides) as illustrated by FIGS. 27 and 28.

FIG. 23B and 23D illustrate an alternative embodiment in which the outer surface of the paper tube 11 is laminated with, instead of said outermost layer 63, synthetic resin layer 65 having the same function as said outermost layer 63. FIGS. 23C and 23D illustrate another alternative embodiment in which the inner fibrous layer 64 is lined with sythetic resin cloth sheet 66 serving to reinforce the paper tube.

A sealed bottom 67 may be a hexagonal as shown by FIG. 26 or may be a pinched bottom as shown by FIGS. 27 and 28.

The filling-sleeve 68 may be provided at an end of the sealed bottom as shown by FIG. 26 or may be formed by folding an end of the bottom inward as shown by FIG. 27 or a sleeve inserted into the paper tube on a longitudinal seam line 70 extending longitudinally of the paper tube as shown by FIG. 28. Reference numeral 69 designates bottom wrapping paper. It should be understood that the outermost layer 13 of the paper tube 11 may comprise pulp fiber paper just as in the first embodiment.

While the invention has been particularly shown and described with reference to preferred embodiment thereof, it will be understood by those skilled in the art that the foregoing and other changes in form and details can be made therein without departing from the sprit and scope of the invention.

What is claimed is:

1. Overtape-sealed bag comprising a paper tube, having longitudinally opposite open ends, at least one of which is covered and sealed with a bifold overtape, wherein the overtape is lined with a synthetic resin sheet and said synthetic resin sheet is bonded to an outer surface of the paper tube proximate an open end thereof with adhesive having penetrated an outermost layer of the paper tube so that a release resistance established between the overtape and the outermost layer of the paper tube is higher than a release resistance established between the overtape and an inner layer of the paper tube not penetrated by said adhesive, and wherein unsealing of the paper bag can occur along a boundary between the outermost layer and the inner layer or along the inner layer itself.

2. Overtape-sealed bag as recited in claim 1, wherein the paper tube has a higher degree of fiber orientation in its longitudinal direction than in its transverse direction and the open ends extend transversely of the paper tube.

3. Overtape-sealed bag as recited in claim 1, wherein the overtape comprises a composite sheet laminated or coated on its inner side with hot melt adhesive.

4. Overtape-sealed bag as recited in claim 1, wherein the outer surface of the paper tube is laminated

5. Overtape-sealed bag as recited in claim 1, wherein the synthetic resin sheet comprises a cloth sheet.

6. Overtape-sealed bag as recited in claim 1, wherein an inner surface of the paper tube is lined with a synthetic resin sheet.

7. Overtape-sealed bag as recited in claim 1, wherein the paper tube is a gusseted paper tube with a side gusset on each side of the paper tube and wherein a pair of mutually opposed outer surface sections of each side gusset are bonded to each other by a gusset adhesive over an area thereof to be covered by the overtape while corresponding inner surface section of each side gusset are not bonded to the inner surfaces of major walls of the paper tube, so as to provide shock absorbing means.

8. Overtape-sealed bag as recited in claim 7, wherein the gusseted paper tube has an intermediate folding line between gusset lines and wherein the adhesive of the overtape extends along each open end of the paper tube beyond the respective gusset lines.

9. Overtape-sealed bag as recited in claim 1, wherein the paper tube is a gusseted paper tube; wherein there is provided adjacent one end of one open end to be covered by the overtape a projection which is, in turn, folded inward along oblique lines to provide a filling-sleeve; and wherein a pair of mutually opposed outer surface sections of said projection are bonded to each other by an adhesive while corresponding inner surfaces of said projection are not bonded to inner surfaces of major walls of the paper tube, so as to provide shock absorbing means.

* * * * *

UNITED STATES PATENT AND TRADEMARK OFFICE

CERTIFICATE OF CORRECTION

PATENT NO. : 4,997,289

DATED : March 5, 1991

INVENTOR(S) : Koji SASAKI and Kaoru TESHIMA

It is certified that error appears in the above-identified patent and that said Letters Patent is hereby corrected as shown below:

Column 14 , line 7:

Claim 4, last line thereof, after "laminated", insert --with synthetic resin film.--.

Signed and Sealed this

Second Day of March, 1993

*Attest:*

STEPHEN G. KUNIN

*Attesting Officer*

*Acting Commissioner of Patents and Trademarks*